United States Patent [19]

Handke

[11] 4,146,763

[45] Mar. 27, 1979

[54] COMPRESSED GAS CIRCUIT BREAKER

[75] Inventor: Siegfried Handke, Berlin, Fed. Rep. of Germany

[73] Assignee: Siemens Aktiengesellschaft, Munich, Fed. Rep. of Germany

[21] Appl. No.: 720,094

[22] Filed: Sep. 2, 1976

[30] Foreign Application Priority Data

Sep. 8, 1975 [DE] Fed. Rep. of Germany ..... 2540315

[51] Int. Cl.[2] ..... H01H 33/88

[52] U.S. Cl. ..... 200/148 R; 200/148 A

[58] Field of Search ..... 200/148 A, 148 R

[56] References Cited

FOREIGN PATENT DOCUMENTS 2209287 9/1973 Fed. Rep. of Germany ..... 200/148 A 2420462 10/1975 Fed. Rep. of Germany ..... 200/148 A

*Primary Examiner*—Robert S. Macon

*Attorney, Agent, or Firm*—Kenyon & Kenyon, Reilly, Carr & Chapin

[57] ABSTRACT

A compressed gas circuit breaker is disclosed. The breaker comprises two fixed hollow contacts which are bridged by a tubular bridging contact member when the breaker is in the closed position. A blasting means provides compressed gas for quenching the arc when the bridging contact is moved to a position whereat it no longer bridges the fixed contacts. The blasting means includes a piston and a blasting cylinder which surrounds the piston. In accordance with the invention, the end portion of the blasting cylinder, which is moved from one fixed contact to the other fixed contact across the gap therebetween during the opening of the breaker is provided with an annular electrode. The latter electrode prevents a recurrence of the arc, without having to increase the gap between the contacts.

4 Claims, 1 Drawing Figure

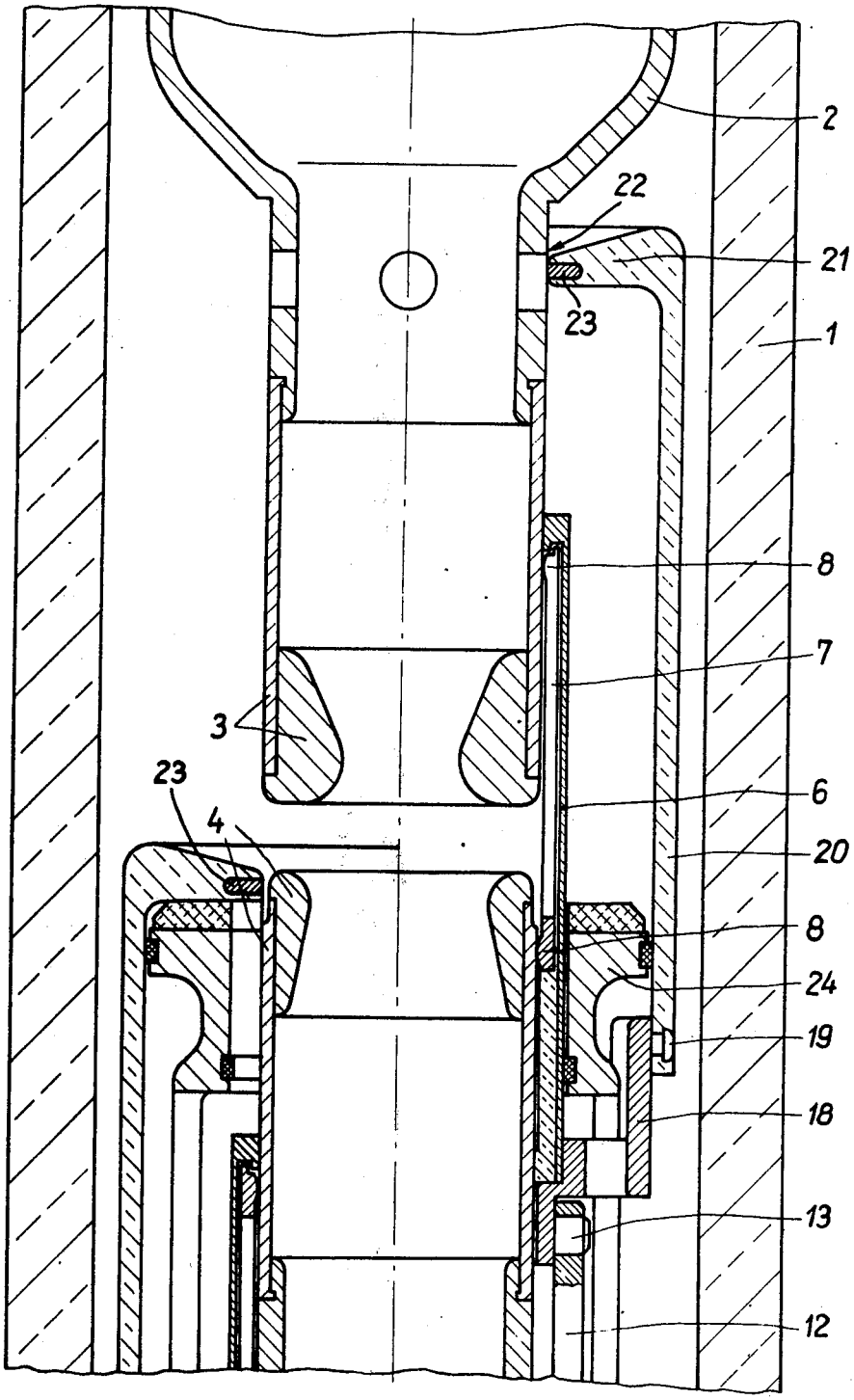
2
22
21
23
1
8
7
3
23
6
4
20
8
24
19
18
13
12

COMPRESSED GAS CIRCUIT BREAKER

BACKGROUND OF THE INVENTION

1. Field of the Invention

The invention relates to a compressed gas circuit breaker comprising two fixed hollow contacts which are bridged by a tubular bridging contact when the breaker is in the closed position. More particularly, it relates to a circuit breaker of the aforesaid type in which a blasting means provides a compressed quenching gas for blasting the arc drawn between the bridging contact and the fixed contacts during opening of the breaker, and in which the blasting means includes a piston and a blasting cylinder surrounding the piston and having an end portion which is moved from one fixed contact to the other via the gap therebetween during the opening of the breaker.

2. Description of the Prior Art

Such a compressed gas circuit breaker is disclosed in the U.S. Pat. No. 3,789,175. In the closed position of the breaker, the blasting cylinder surrounds one fixed contact, forming a seal therewith. As the bridging contact and, hence, the blasting cylinder are moved, the sulfurhexafluoride ($SF_6$), gas provided as the quenching medium is compressed by the motion of the blasting cylinder in relation to the piston, which is maintained stationary. When the bridging contact no longer bridges the fixed contacts, i.e., when it ceases to contact the aforesaid one fixed contact, an arc is formed under load, the latter arc, in turn, being blasted and cooled by the compressed quenching gas. In the process, the quenching gas is driven into the gap between the two fixed contacts and therefrom into the interior of the contacts for the discharging of same.

In designing the aforesaid compressed gas circuit breaker, it is desirable to keep the gap between the fixed contacts as small as possible. However, when switching capacitive currents which result in comparatively high recurring voltages, the use of a small gap causes uneven surface charges to exist on the insulating blasting cylinder. At high field strengths, this uneven surface charge can lead to a breakdown and thus to a recurrence of the arc.

It is an object of the present invention to provide a compressed gas circuit breaker of the type described above which has both an increased protection against arc recurrence and a small gap between its fixed contacts.

SUMMARY OF THE INVENTION

In accordance with the principles of the present invention the above and other objectives are accomplished in a compressed gas circuit breaker of the above type by further including therein an annular electrode positioned adjacent the end portion of the blasting cylinder which is moved from one contact to the other via the gap therebetween during opening of the breaker. Such an electrode causes an even or uniform charge distribution on the blasting cylinder and serves as a collecting electrode. As a result, a recurrence of the arc is thereby prevented.

The aforesaid annular electrode may be comprised of a conducting or semiconducting material. Advantageously, an electrically conducting metal may be employed.

For a favorable energy balance in the drive system of the breaker, it is particularly desirable to maintain the weight of the blasting cylinder and, hence, the weight of the electrode at a minimum. As a result, aluminum is a particularly advantageous metal which may be employed for the electrode.

The annular electrode may, advantageously, be embedded in the end portion of the blasting cylinder, since the coefficient of expansion of the electrode material (e.g., aluminum) can be matched to that of the blasting cylinder material (e.g., resin provided with a filler). In addition, other techniques for fastening the electrode to the end portion of the blasting cylinder may also be employed.

BRIEF DESCRIPTION OF THE DRAWINGS

The above and other features and aspects of the present invention will become more apparant upon reading the following detailed description in conjunction with the accompanying drawings, in which:

FIG. 1 shows in schematic fashion a compressed gas circuit breaker in accordance with the principles of the present invention.

DETAILED DESCRIPTION

FIG. 1 shows a compressed gas circuit breaker in accordance with the principles of the present invention. For the sake of simplicity, only those portions of the breaker necessary for an understanding of the invention have been specifically shown. Thus, the drive mechanism and support insulators have not been illustrated.

The breaker of FIG. 1 employs a quenching gas such as, for example, sulfurhexafluoride, as the quenching medium and includes a switching chamber which can be made of porcelain and which carries at its upper end a connector. Fastened to the connector is a hollow, metallic member 2 which protrudes into the interior of the switching chamber 1 and carries with it a fixed hollow contact 3. The contact 3 is disposed coaxially with an opposite to a second fixed hollow contact 4. Both hollow contacts 3 and 4 provide a means for discharging the gas of the breaker, and each is formed into a nozzle at its free end.

In the closed position of the breaker the two fixed contacts are connected or bridged by a tubular bridging contact 6. Mounted inside the tubular bridging contact 6 are spring-loaded fingers 7 whose contact surfaces 8 are pressed against the fixed contacts 3 and 4. The tubular bridging contact 6 is screwed into a coupling member 18 which is connected to a blasting cylinder 20 of a blasting means by way of a fastening element 19. The end portion 21 of the blasting cylinder 20 surrounds the fixed contact 3 via an opening 22. Typically, the blasting cylinder 20 may be of a one-piece construction formed from a fiber-reinforced plastic.

During the opening of the breaker, the blasting cylinder 20 and the bridging contact 6 are pulled toward a stationary piston 24 of the blasting means so that the quenching gas within the cylinder is compressed. This is accomplished by movement of the coupling member 18 which is pulled by the pull rods 12 which are linked to the member via a bolt 13. Coupled to the pull rods 12 is a drive member (not shown in detail) which moves the rods so as to open and close the breaker. The portion of FIG. 1 to right of centerline illustrates the breaker in the open position and the portion to the left of the centerline shows the breaker in the closed position.

The switching chamber 1 is filled completely with quenching gas at a pressure at, say, 4 bar. To open the breaker, the bridging contact 6, together with the blasting cylinder 20 are moved downward. This causes the gas present within the blasting cylinder 20 to be compressed, since it is not yet able to discharge into the fixed contacts 3 and 4 due to the presence of the bridging contact 6. After the blasting cylinder 20 has completed approximately half its stroke, the bridging contact 6 slides off the fixed contact 3 so that an outlet area is provided for the quenching gas as it is being compressed by the blasting cylinder 20. The aforesaid gas flows into and through the end nozzles of the two fixed contacts 3 and 4. During this process, an arc is commutated from the bridging contact 6 to the burn-off electrodes of arc-resistant material which are provided at the fixed contact 4, and is quenched by the quenching gas due to the favorable flow conditions prevailing at the contact nozzles.

Under some circumstances, the end portion 21 of the blasting cylinder, in the course of the breaker opening, is still in contact with the fixed contact 3 when the arc is already quenched. It is only in the open position of the switch that the blasting cylinder assumes the position shown to the left of the centerline in FIG. 1.

During the opening of the breaker, the blasting cylinder 20, which is comprised of an insulating material, can take on electrostatic surface charges which can lead to recurrence of the arc when the opening 22 of the end 21 traverses the gap between the fixed contacts 3 and 4. In accordance with the invention, such a recurrence of the arc is prevented by providing adjacent the end portion 21 of the cylinder, an annular electrode 23. The latter electrode acts as a collecting electrode and inhibits the discharge of any electrostatic charges which may have built up on the blasting cylinder.

In the present illustrative embodiment, the electrode 23 is embedded in the end portion 21 and is comprised of an electrically conductive metal. Advantageously, aluminum may be employed as the electrode metal. In such case, embedding the electrode 23 in the end portion of the cylinder has little effect on the weight of the blasting cylinder. The necessity for substantially increasing the drive power is thereby avoided.

What is claimed is:

1. In a compressed gas circuit breaker which includes: two fixed hollow contacts for discharging said gas when opening said breaker; a tubular bridging contact which bridges said fixed contacts when said breaker is in the closed position; a blasting means for providing said gas for quenching the arc drawn when the bridging contact is moved to a position where it ceases to bridge said fixed contacts thereby opening said breaker, said blasting means including a piston and a blasting cylinder surrounding said piston, said blasting cylinder being responsive to the movement of said bridging contact during the opening of said breaker and having an end portion which surrounds one of said fixed contacts and is moved therefrom across the gap between said fixed contacts during said opening; the improvement comprising: an annular electrode carried by said blasting cylinder and arranged adjacent said end portion, said electrode comprising a electrically conductive material.

2. A circuit breaker in accordance with claim 1 in which said electrode is made of a metal.

3. A circuit breaker in accordance with claim 1 in which said electrode is made of aluminum.

4. A circuit breaker in accordance with claim 1 in which said electrode is embedded in said end portion.

* * * * *